United States Patent [19]

Hatano et al.

[11] Patent Number: 4,915,289

[45] Date of Patent: Apr. 10, 1990

[54] EASILY OPENABLE SEALED CONTAINER

[75] Inventors: Yasushi Hatano, Yokohama; Tamio Fujiwara, Izumi-Sano; Michio Watanabe, Yokohama; Hideo Kurashima, Yokosuka; Kazuo Taira, Tokyo; Kazuma Kuse, Yokohama, all of Japan

[73] Assignee: Toyo Seikan Kaisha, Ltd., Tokyo, Japan

[21] Appl. No.: 354,315

[22] PCT Filed: May 20, 1988

[86] PCT No.: PCT/JP88/00481

§ 371 Date: Mar. 8, 1989

§ 102(e) Date: Mar. 8, 1989

[87] PCT Pub. No.: WO88/09292

PCT Pub. Date: Dec. 1, 1988

[30] Foreign Application Priority Data

May 20, 1987 [JP] Japan ..... 62-121185
Oct. 22, 1987 [JP] Japan ..... 62-265313

[51] Int. Cl.[4] ..... B65D 51/00

[52] U.S. Cl. ..... 229/123.1; 206/631; 206/632; 220/359; 229/125.35; 383/94

[58] Field of Search ..... 206/631, 632, 631.3; 220/359; 229/123.1, 123.2, 125.35; 383/93, 94

[56] References Cited

U.S. PATENT DOCUMENTS

| | | | |
|---|---|---|---|
| 3,104,798 | 9/1963 | Stone | 206/632 |
| 3,192,091 | 6/1965 | Hey et al. | 229/125.35 |
| 3,272,422 | 9/1966 | Miller | 229/123.1 |
| 3,454,210 | 7/1969 | Spiegel et al. | 229/123.1 |
| 3,608,707 | 9/1971 | Miller | 206/631 |
| 3,625,414 | 12/1971 | Caiola | 383/93 |
| 3,827,625 | 8/1974 | Miller | 206/632 |
| 4,091,930 | 5/1978 | Buchner et al. | 229/123.2 |
| 4,518,087 | 5/1985 | Goglio | 206/632 |
| 4,659,405 | 4/1987 | Walter | 220/359 |
| 4,712,727 | 12/1987 | Wyberg | 206/631.3 |
| 4,756,426 | 7/1988 | Wyberg | 206/631.3 |
| 4,762,234 | 8/1988 | Wyberg | 206/631.3 |
| 4,801,041 | 1/1989 | Takata et al. | 220/359 |

*Primary Examiner*—Gary Elkins
*Attorney, Agent, or Firm*—Sughrue, Mion, Zinn, Macpeak & Seas

[57] ABSTRACT

A container composed of a plurality of container materials the opposing parts of which are sealed by heat sealing, wherein at least an opening start part of the sealed portion is of a laminated structure consisting of the plurality of container materials and an intermediate material inserted therebetween. The intermediate material and one of the container materials are tightly sealed, and the intermediate material and another of the container materials are sealed easily peelably. The inside end edge of the easily peelable seal portion is positioned more toward the center of the container than the inside end edge of the tight seal portion. At an opening start position, the outside end edge of the easily peelable seal portion is positioned more toward the center of the container than the outside end edge of the tight seal portion, and the intermediate material is provided so as to jut outwwardly of a heat sealing flat portion of a container flange. The strength of peeling of this sealed container from its central side is high enough to withstand retorting or the like, and opening of the container from outside can be effected by hand accurately and stably.

7 Claims, 8 Drawing Sheets

EASILY OPENABLE SEALED CONTAINER

FIELD OF TECHNOLOGY

This invention relates to an easily openable container. More specifically, it relates to an easily openable container of which peel strength in a direction from its central side is high enough to withstand an increase of the internal pressure by sterilization such as retorting or boiling or falling impact and which can be exactly and stably opened by hand from its outside.

TECHNOLOGICAL BACKGROUND

Heretofore, heat-sealed packaging materials have been widely used in many fields including food packaging, and in particular, those which can be peeled at the heat-seal interface have been widely used as easily openable or peelable heat-sealed closures.

In a peelable container, sealing characteristics and opening characteristics are in a contradictory relation, and when the sealing characteristics are such as to withstand the increasing of the internal pressure at the time of retorting sterilization, its opening characteristics will be impaired. For example, in Japan, heat-sealed packages containing retorted goods should have a seal strength at the heat-sealed part of at least 2.3 kg/15 mm width. When the seal strength between a container body and a closure reaches this value, it is difficult to perform hand peeling on the heat-sealed interface between the two.

As a solution to this problem, Plastics, Vol. 38, No., 5, page 65 (1987) already proposed a heat-sealed container in which a heat-sealable inner surface material layer is provided throughout its entire inner surface, the inner material layer and a layer located inwardly thereof are sealed for easy peeling, the inner material layer and a closure are sealed tightly, and a score for cutting of the inner surface layer is provided at a site more toward the center than the heat seal portion whereby opening from outside is rendered easy while the heat seal strength outwardly from the center is maintained at 2.3 kg/15 mm or higher.

The above-mentioned easily openable heat-sealed container is very significant in that easy openability is imparted to the package while the seal strength is maintained at 2.3 kg/15 mm or higher. But the structure or production of the container is limited because, for example, the container must be subjected to score formation. Furthermore, to form a score inwardly of its heat sealing peripheral portion, the material of which the container is made is restricted. For example, a laminated container including an interlayer of a metallic foil such as a steel foil becomes useless because of rust formation at the score portion. Moreover, to provide the score, the area of the flange portion of the container naturally becomes large; consequently, the amount of the container material used and the bulk of the package increase and the appearance characteristics of the container become undesirable.

Generally, it is never the case with easily openable heat-sealed containers that they can be easily opened if simply an easily peelable seal is provided in the heat-sealed portion. To start opening easily, it is necessary to design the container such that stresses will be concentrated on an opening start part of the easily peelable seal portion.

OBJECTS OF THE INVENTION

It is an object of this invention therefore to provide an easily openable sealed container of which strength of peeling or breakage from its central side is high enough (for example, at least 2.3 kg/15 mm width) to withstand falling impact or the increasing of the inside pressure by retorting, etc.; of which strength of peeling from its outside is maintained at an easily openable heat seal strength; and in which at the start of opening, stresses are concentrated on its easily peelable seal portion to permit accurate and stable opening by hand.

Another object of this invention is to provide an easily openable sealed container in which the aforesaid anisotropy of peel strength is achieved without forming a score on the container or its closure.

STRUCTURE OF THE INVENTION

According to a first embodiment of the invention, there is provided a container composed of a plurality of container materials the opposing parts of which are sealed by heat sealing, wherein at least an opening start part of the sealed portion is of a laminated structure consisting of the plurality of container materials and an intermediate material inserted therebetween, the intermediate material and one of the container materials are tightly sealed, the intermediate material and another of the container materials are sealed easily peelably, the inside end edge of the easily peelable seal portion is positioned more toward the center of the container than the inside end edge of the tight seal portion, and at an opening start position, the outside end edge of the easily peelable seal portion is positioned more toward the center of the container than the outside end edge of the tight seal portion.

According to a second embodiment of the invention, there is provided an easily openable sealed container composed of a cup-shaped container body having a heat sealing flange and a closure which are sealed by heat sealing, wherein at least an opening start part of the sealed portion has an intermediate material inserted so as to jut outwardly of a heat sealing flat portion of the flange, the intermediate material and the flange are sealed easily peelably, the intermediate material and the closure are tightly sealed, the inside end edge of the easily peelable seal portion is positioned more inwardly of the container than the inside end edge of the tight seal portion, and at an opening start position, the outside end edge of the tight seal portion is positioned more outwardly than the heat sealing flat portion of the flange.

FUNCTION

Figure 1:
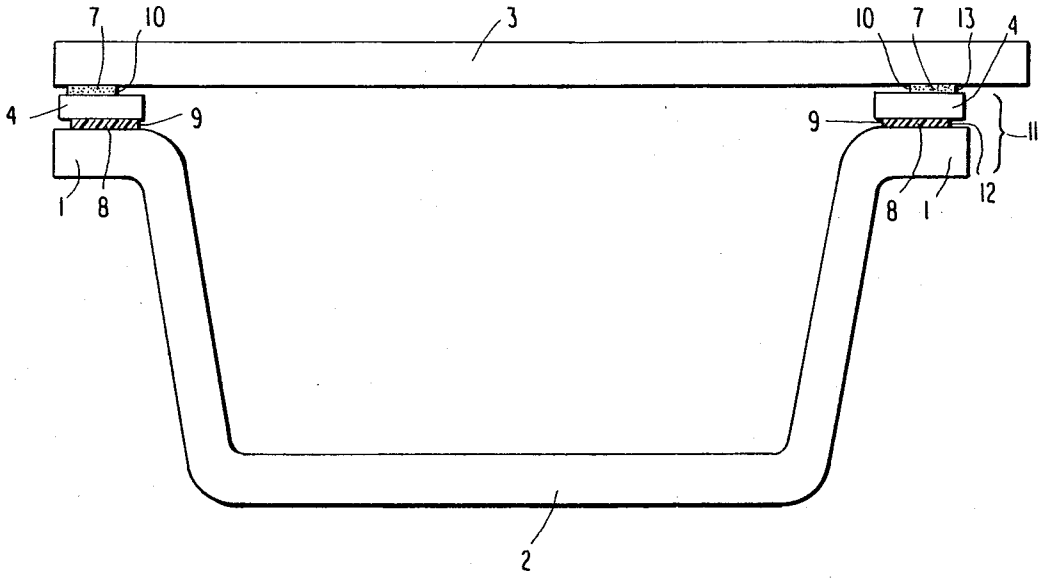
FIGS. 1, 4, 5 and 10 are sectional views showing one example of the easily openable sealed container of this invention.

In FIG. 1 showing one example of a container in accordance with the first embodiment of the invention, the container is composed of a container body 2 having a heat sealing flange 1 and a closure 3. An intermediate material 4 is provided between the flange 1 and the closure 3. In the specific embodiment shown in FIG. 1, a tight seal 7 is formed between the intermediate material 4 and the closure 3, whereas an easily peelable seal 8 is formed between the intermediate material 4 and the flange 1.

The inside end edge 9 of the easily peelable seal portion 8 is positioned more toward the center of the container than the inside end edge 10 of the tight seal portion 7, and at an opening start part 11, the outside end edge 12 of the easily peelable seal portion 8 is positioned more toward the center than the outside end edge 13 of the tight seal portion 7.

Figure 2:
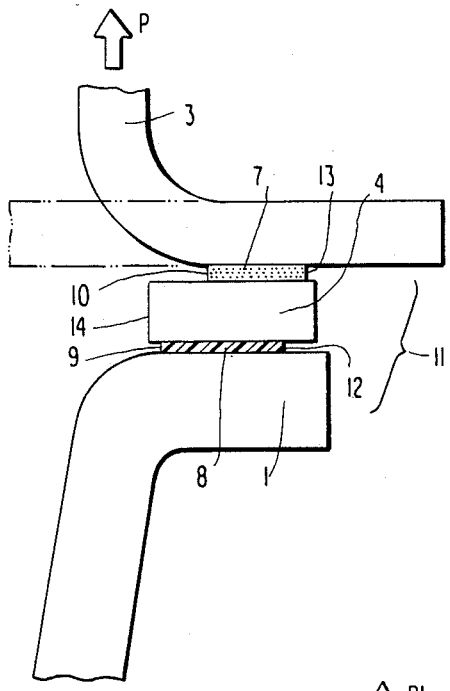
FIGS. 2 and 6 are sectional views showing the state in which a peeling force acts on a sealed portion of the easily openable sealed container of the invention from its inside.

In FIG. 2 showing the state in which a peeling force acts on the sealed portion from inside, the inside end edge 14 of the intermediate material 4 is in intimate contact with the flange 1, and the inside end edge 9 of the easily peelable seal 8 is positioned more toward the center than the inside end edge 10 of the tight seal portion 7. Accordingly, the peeling or breaking force P from inside acts on the tight seal portion 7, and a high peel or break strength of, for example, at least 2.3 kg/15 mm width can be obtained.

Figure 3:
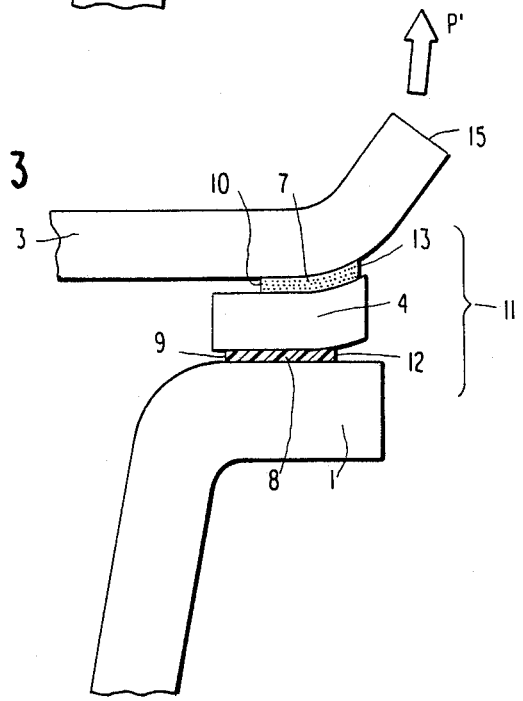
FIGS. 3 and 7 are sectional views showing the state in which a peeling force acts on an opening start portion of the easily openable sealed container of the invention from its outside.

On the other hand, in FIG. 3 showing the state in which a peeling force from outside acts on the opening start part 11 of the sealed portion, when the end portion 15 of the closure 3 is held and pulled upwardly, the peeling force P' acts on the easily peelable seal portion 8 since the outside end edge 12 of the easily peelable seal portion 8 is positioned more toward the center than the outside end edge 13 of the tight seal portion 7. The peel strength becomes less than 2 kg/15 mm, for example, and the closure can be easily peeled and opened by hand.

Figure 4:
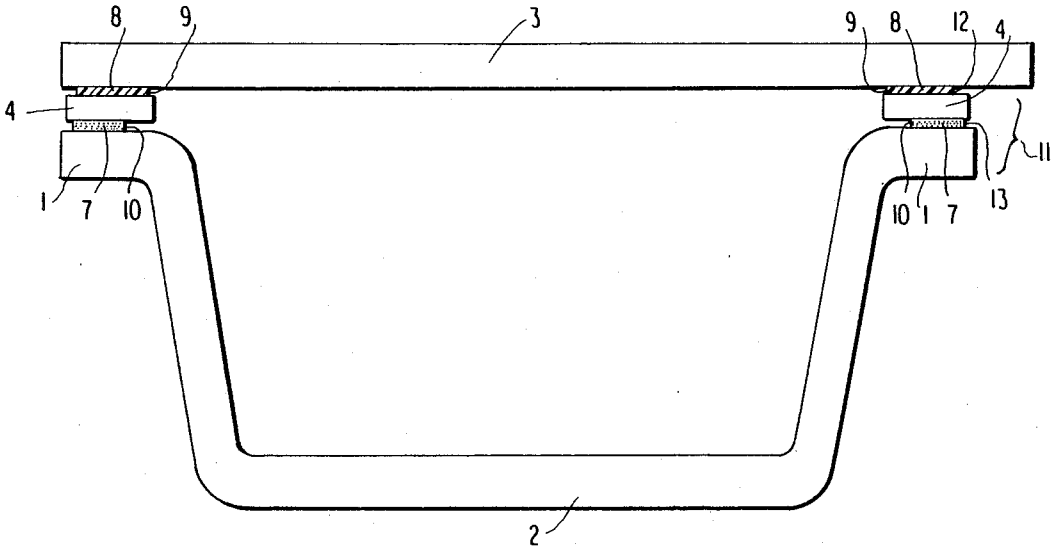

In the heat seal structure shown in FIG. 1, the intermediate material 4 is left on the closure after opening, and the flange portion 1 presents a clear appearance. However, as shown in FIG. 4, the tight seal portion 7 and the easily peelable seal portion 8 may be inverted so that the intermediate material 4 may be left on the cup side after opening.

Figure 5:
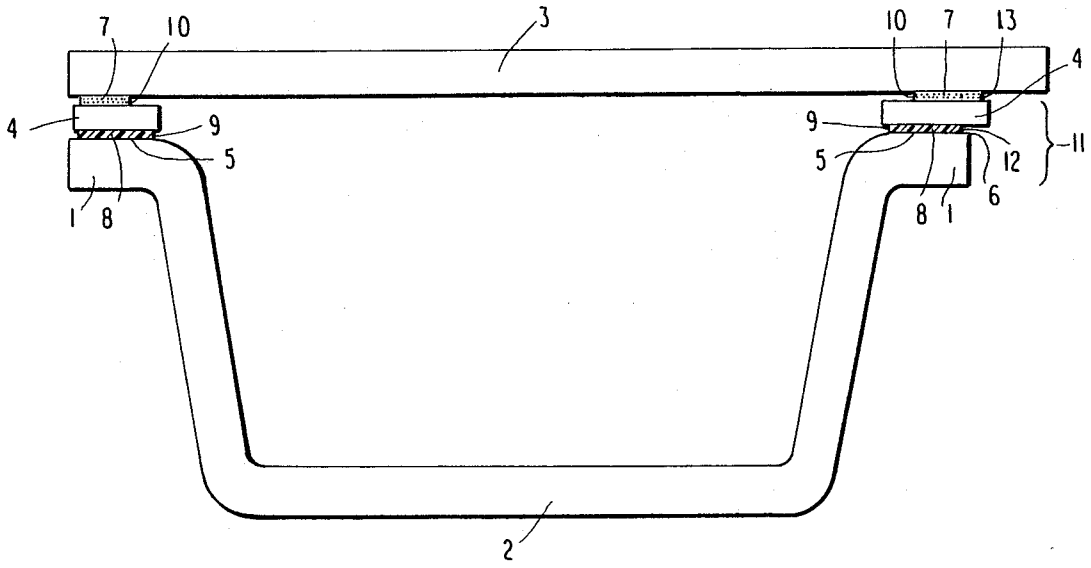

In FIG. 5 showing an example of a container in accordance with the second embodiment of this invention, the container is composed of a container body 2 having a heat sealing flange 1 and a closure 3. A seal by heat sealing is formed between the flange 1 and the closure 3. In this invention, the intermediate material 4 is provided in a specific positional relation at least at an opening start part of the sealed portion. Specifically, the flange 1 has a heat sealing flat portion 5, and the intermediate material 4 is provided so as to jut out from the peripheral edge 6 of the heat sealing flat portion 5.

In the specific example shown in FIG. 5, a tight seal 7 is formed between the intermediate material 4 and the closure 3, whereas an easily peelable seal 8 is formed between the intermediate material 4 and the flat portion 5 of the flange.

The inside end edge 9 of the easily peelable seal portion 8 is positioned more toward the inside of the container than the inside end edge 10 of the tight seal portion 7, and at the opening start part 11, the outside end edge 12 of the easily openable seal portion 8 is positioned more toward the inside of the container than the outside end edge 13 of the tight seal portion 7.

Figure 6:
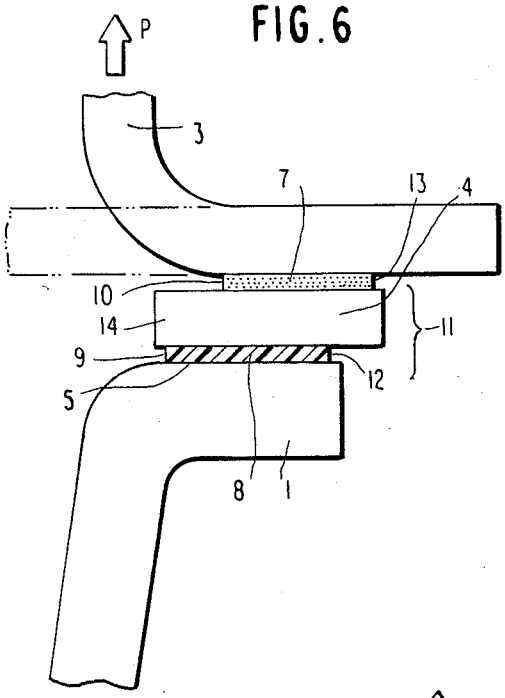

In FIG. 6 showing the state in which a peeling force acts on the sealed portion from inside, the inside end edge 14 of the intermediate material 4 is in intimate contact with the flange 1 or with the container beyond the flange 1. Moreover, the inside end edge 9 of the easily peelable seal portion 8 is positioned more toward the inside of the container than the inside end edge 10 of the tight seal portion 7. Hence, the peeling or breaking force P from the inside acts on the tight seal portion 7, and a high peel or break strength of, for example, more than 2.3 kg/15 mm width can be obtained.

Figure 7:
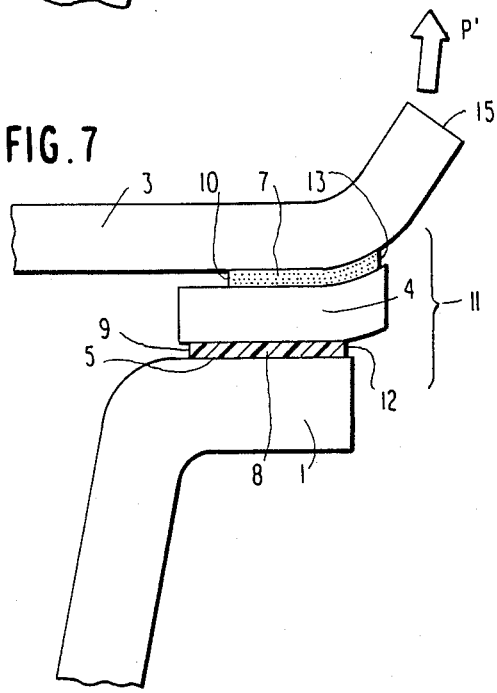

On the other hand, in FIG. 7 showing the state in which a peeling force P' acts on the opening start position of the sealed portion from outside, when the end portion 15 of the closure 3 is held and pulled upwardly, the end portion of the intermediate material 4 is lifted together with the closure because the intermediate material 4 juts outwardly of the flat portion of the flange, and the outside end edge 13 of the tight seal portion 7 formed between the intermediate material 4 and the closure 3 is positioned outwardly of the outside end edge 12 of the easily peelable seal portion 8. As a result, the peeling force P' is concentrated on the outside end edge 12 of the easily peelable seal portion 8 to permit accurate and stable starting of opening by hand, and the peel strength from outside can be maintained within a range of an easily peelable seal strength of less than 2 kg/15 mm width.

Figure 8:
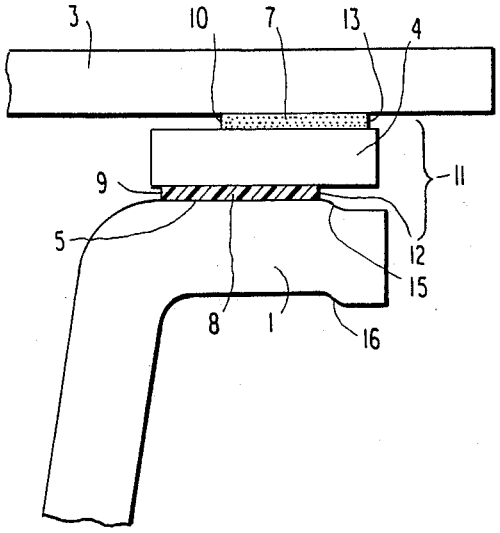
FIGS. 8, 9 and 12 are sectional views of essential parts showing an example of application of an intermediate material.

In the heat seal structure shown in FIG. 5, substantially all the flange 1 constitutes the heat sealing flat portion 5, and the intermediate material 4 is provided so as to jut outwardly of the peripheral end portion 6 of the flat portion 5. But as shown in FIG. 8, the same function can be achieved by forming the flange 1 from the heat sealing flat portion 5 and a peripherally extending portion 16 provided outwardly and downwardly of the flat portion via a step 15 and providing no heat seal between the intermediate material 4 and the peripherally extending portion 16.

In the containers of this invention according to the first and second embodiments, the intermediate material 4 may be provided over the entire circumference of the sealed portion; or it may be provided only in the opening start part 11. A site at which the opening strength becomes highest at the time of opening is where the peel width in the sealed portion becomes widest. Generally, it is the opening start part 11. Even when the seal strength between the container body 2 and the closure 3 is strong, for example, 2.3 to 3 kg/15 mm width, the same effect as the aforesaid function can be obtained by inserting the intermediate material 4 into the opening start part 11, providing the tight seal 7 on one side of the intermediate material 4 and the easily peelable seal 8 on the other side, and restricting their positions. Consequently, the maximum value of the opening strength is reduced, and the opening becomes easy.

PREFERRED EMBODIMENTS OF THE INVENTION

In order to form a tight seal on one side of the intermediate material and an easily peelable seal portion on the other side of the intermediate material in this invention, a difference in heat seal strength between the intermediate material and an inner surface material of the closure or an inner surface material of the container is utilized.

For example, when the intermediate material is a polypropylene film, a tight seal is formed if the inside surface of the closure or the container is formed of polypropylene. If the inside surface of the closure or the inside surface of the container is formed of polypropylene and another polymer, for example a blend of polypropylene with polyethylene, ethylene/vinylacetate copolymer or ethylene/propylene rubber, an easily peelable seal is formed. When the intermediate material is a laminated structure composed of a polypropylene layer and a layer of the polymer blend mentioned above and the inside surface of the closure and the inner surface of the container are both made of polypropylene, a tight seal is formed on the polypropylene layer side and an easily peelable seal, on the blend layer side. These examples also apply to a heat-sealable resin such as polyethylene, polyesters and polyamides.

It is known that a polyolefin film has heat-sealability with respect to a certain coated film. The polyolefin film shows excellent heat-sealability to a coated film having oxidized polyethylene or an acid-modified olefinic resin dispersed therein. It is possible to form a tight seal on one side of the polyolefin film and an easily peelable seal on the other side by providing this coated film on the inside surface of the closure or on the inside surface of the container body and adjusting the amount of oxidized polyethylene or the acid-modified olefinic resin dispersed or the amount of a third component which impairs heat-sealability. This tendency also applies to resins which show heat sealability with respect to paints, such as polyesters and polyamides.

Microscopically, peeling at the easily peelable seal portion appears to be interfacial peeling between the intermediate material and the inner surface material of the closure or between the intermediate material and the inner surface material of the container. When seen microscopically, this peeling occurs as a result of phenomena of fracture such as interfacial peeling on the heat seal interface, cohesive fracture in the vicinity of this interface and delamination, either singly or in combination.

The positions of the inside and outside end edges of the easily peelable seal portion and the positions of the inside and outside end edges of the tight seal portion can be adjusted by any desired means. Most simply, the positions of these inside and outside end edges can be adjusted by restricting the shape and position of a heat seal head in heat sealing the intermediate material to the closure or container flange.

Alternatively, the positions of the inside and outside end edges of the heat seal portions can be adjusted by applying a non-adhesive film defining the inside or outside end edge of the heat seal portions to the surface of the flange, the inside surface of the closure or the intermediate material by printing, coating, vapor deposition, welding or by other known film-forming techniques.

Figure 9:
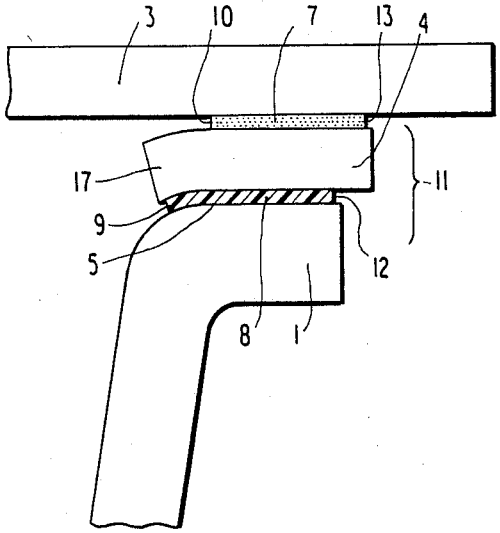
Figure 12:
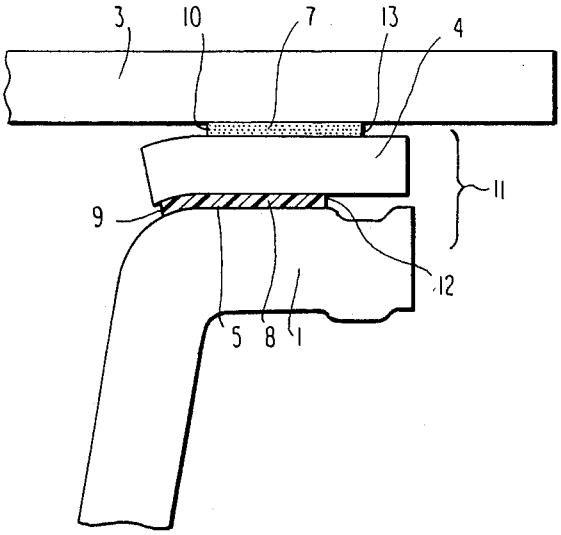

In the second embodiment of this invention, the adjustment of the positions of the outside end edge of the easily peelable seal portion and the outside end edge of the tight seal portion in heat sealing generally becomes unnessary by providing the intermediate material so that it juts outwardly of the heat sealing flat portion. For example, when an easily peelable seal is first formed between the inner surface material of the container and the intermediate material, and then a tight seal is formed between the intermediate material and the inner material of the closure, the outside end edge of the easily peelable seal portion may sometimes be deviated and positioned at the same position as the outside end edge of the tight seal portion, or the positions of these may be reversed, depending upon the kinds of materials constituting the closure or the intermediate material in the container shown in FIG. 1 or upon the heat sealing conditions. However, in the second embodiment of the invention, heat sealing is carried out so that the outside end edge of the tight seal portion is positioned outwardly of the heat sealing flat portion. Thus, even when the position of the outside end edge of the easily peelable seal portion is deviated, it is never positioned outwardly of the heat sealing flat portion, and the positional relation between the outside end edges of the seal portions at the opening start part is exactly regulated. Furthermore, as shown in FIGS. 9 and 12, when the intermediate material is provided so that it has a portion 17 jutting inwardly of the sealing flat portion 5 of the flange and the jutting portion 17 of the intermediate material is heat-sealed to the container side, an advantage can be obtained in that the regulation of the position of the inside end edge of the tight seal portion also becomes unnecessary.

In the present invention, a predetermined difference can be provided between the peel or break strength from the center of the container and the peel strength from outside the container by providing heat seal surfaces of different bond strengths, i.e., a tight seal portion and an easily peelable seal portion, via the intermediate material and restricting the positions of their inside end edges and outside end edges. Furthermore, this difference can be preset as desired by properly selecting various conditions such as the bond strengths of the tight seal portion and the easily peelable seal portion, the positional relation of the inside and outside end edges of the seal portions and the strength of the intermediate material. For example, to allow good sealing properties and opening properties to stand together, it is advisable to increase the difference in bond strength between the tight seal portion and the easily peelable seal portion, for example by adjusting the bond strength of the tight seal portion to at least 2.5 kg/15 mm width, desirably at least 3 kg/15 mm width and the bond strength of the easily peelable seal portion to at least 0.2 kg/15 mm width but not exceeding 2 kg/15 mm width, desirably to 0.4 kg/15 mm width to 1.5 kg/15 mm width, and limiting the amount of positional shifting of the inside and outside end edges of the seal portions to at least 0.5 mm, desirably at least 1 mm, and for practical purposes, below 5 mm. The intermediate material should desirably have such properties and thickness that it is difficult to elongate and cut.

The container body and the closure may be formed of any known container-forming material, for example resins, metals, paper, glass, ceramics or laminated structures of these materials. Preferably, at least the inside surfaces of the container body and the closure are made of a resin having heat-sealability with respect to the intermediate material. For example, they may be composed of olefinic resins such as polyethylenes having low, medium and high densities, isotactic polypropylene, propylene/ethylene copolymer, ethylene/vinyl copolymer, and olefinic resins graft-modified with ethylenically unsaturated carboxylic acids or anhydrides thereof; polyamides of copolyamides having a relatively low melting or softening point; polyesters or copolyesters having a relatively low melting or softening point; and polycarbonate resins, although they are not limited to these specific examples. These resins may be filled with inorganic fillers.

The container body may be formed from these resins singly, or a laminated container further containing a metal foil such as an aluminum, steel or tin-plated steel foil. It may also be a known metallic container made by applying a known resin coating such as a coating of a thermosetting resin or a thermoplastic resin on such a metallic material.

The closure may be composed of a substrate, for example a metal foil such as an aluminum, tin, steel or tin-plated steel foil, a high oxygen-barrier resin film such as a film of an ethylene/vinyl alcohol copolymer, a vinylidene chloride resin or a nylon resin, a thermoplastic resin film such as a biaxially stretched polyethylene terephthalate film, a biaxially stretched nylon film or a polycarbonate film, various types of paper, or a laminate of these, and the aforesaid heat-sealable resin layer laminated on the substrate as an inner surface material.

The intermediate material may be a film composed of at least one layer of the above-mentioned heat-sealable resin, and should have such a thickness as to withstand at least forces generated at the time of opening, retorting and falling impact. Desirably, it has a thickness of generally 15 to 1000 μm, especially 30 to 100 μm, although it may vary depending upon the material of which the intermediate material is made.

The intermediate material may be produced by any desired method. If the intermediate material is formed in a single layer, it may also be produced by an injection method or a compression molding method. In view of variations in thickness, the use of a casting method or an inflation method is desirable. When the intermediate material is composed of a multiplicity of layers, there may be used a co-extrusion method using a multilayered die, a method comprising extrusion-coating a necessary layer on a pre-shaped substrate, a method comprising heat-laminating substrates, or a method comprising laminating substrates by sandwich lamination.

The present invention is especially useful in an application where articles to be contained are sterilized by retorting or boiling or by filling. From the viewpoint of thermal resistance, it is the general practice to form the inner surface materials of the container body and the closure from a polypropylene resin. An intermediate material especially suitable for this application may be, for example, a material composed of a polypropylene layer having a thickness of 15 to 1000 μm, especially 30 to 100 μm, and a layer having a thickness of 1 to 100 μm, especially 3 to 50 μm and composed of a blend of crystalline propylene/ethylene random copolymer having an ethylene content of not more than 10% and polyethylene in a ratio of from 90:10 to 50:50.

The polypropylene layer is advisably a layer composed of a homopolymer of propylene or a propylene-/ethylene block copolymer having an ethylene content of not more than 10%, or may be one which further contains crystalline propylene/ethylene random copolymer having an ethylene content of not more than 10% formed on the outside of this layer for improving heat sealability. The blend layer may further comprise a third component such as propylene/ethylene rubber.

Figure 10:
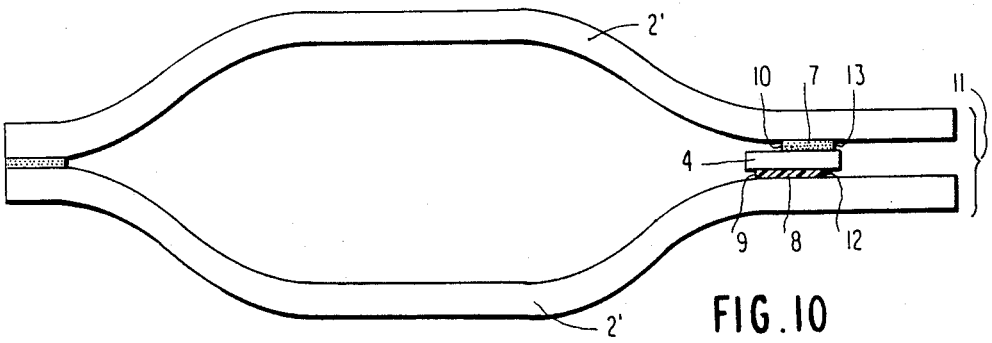

While the present invention has been described with respect to a sealed container composed of a cupshaped container body and a closure, the present invention can also be applied to a container obtained by heat sealing two pieces of a pouch-constituting material at their outside surfaces. In FIG. 10 showing one example of this container, pouch-forming materials 2' and 2' are heat sealed via an intermediate material 4, and a tight seal 7 is formed on one side of the intermediate material, and an easily peelable seal 8, on the other side. The positional relations of the end edges of these seal portions are the same as in the first embodiment of the invention shown in FIG. 1. The intermediate material 4 may be provided over the entire circumference of the pouch or only that portion of the pouch which is to be opened.

EFFECTS OF THE INVENTION

According to this invention, a predetermined difference can be provided between the peel or break strength of the container from its central side and the peel strength of the container from its outside, without forming a score in the container or the closure, by providing a tight seal portion and an easily peelable seal portion on opposite sides of an intermediate material and regulating the positions of their inside end edges and outside end edges or by providing an intermediate material in a specified jutting relationship at least in an opening start part of a sealed portion between the flanged container and the closure and forming a tight seal between the intermediate material and the closure and an easily peelable seal between the intermediate material and the flange. Furthermore, peeling can be started accurately and stably by concentrating a peeling force on the end of the easily peelable seal in starting to open the container.

EXAMPLES

Example 1

The specifications of the closure material, cup-shaped container and intermediate material used in Example 1 are shown below.

Closure Material

A soft aluminum foil having a thickness of 9 μm was laminated to a biaxially stretched polyethylene terephthalate film having a thickness of 12 μm by using a urethane-type adhesive to form a substrate. A non-stretched isotactic polypropylene film having a thickness of 70 μm was laminated as a seal layer to the aluminum side of the substrate by using a urethane-type adhesive to form a closure material.

Cup-Shaped Container

A non-stretched isotactic polypropylene film having a thickness of 40 μm was laminated to one surface of a surface-treated steel foil having a thickness of 75 μm, and a non-stretched isotactic polypropylene film having a thickness of 70 μm, to the other surface of the steel foil, both by using a urethane-type adhesive. The laminated structure was deep-drawn so that the 70 μm non-stretched isotactic polypropylene film side became a seal surface, and a round container having a heat sealing flange with a width of 6 mm was obtained.

Intermediate Material

A two-layered co-extruded film prepared from an isotactic polypropylene layer having a thickness of 50 μm and a 5 μm-thick layer composed of a blend of an ethylene/propylene random copolymer and 30% by weight of linear low-density polyethylene using a T-die.

A sealed container of the type shown in FIG. 1 was constructed by using the above closure material, cup-shaped container and intermediate material.

An easily peelable seal was formed between the container and the intermediate material by heat sealing. After water was filled in the container to an extent of about 90% of the total volume, a tight seal was formed between the intermediate material and the closure to seal up the container. The sealing conditions for forming the easily peelable seal and the tight seal are shown in Table 1. The positions of the inside and outside end edges of the easily peelable seal portion and the positions of the inside and outside end edges of the tight seal portion were limited by regulating the shape and position of a heat seal bar. The seal widths of the easily peelable seal portion and the tight seal portion were adjusted respectively to 3 mm and 2 mm. The distance between the inside end edges of the seals was adjusted to 1.5 mm, and the distance between their outside end edges, to 0.5 mm.

The peel strength of the resulting sealed and filled container was measured before and after it was retorted at 120° C. for 50 minutes. Specifically, a rectangular sample with a width of 15 mm was cut out from the container at right angles to the sealing direction. The closure side of the rectangular sample was clamped by an upper chuck, and the side wall of the cup by a lower chuck. The sample was pulled vertically at a speed of 300 mm/min. The results of measurement made from the inside of the container and the result of measurement from outside at the opening start part are shown in Table 1.

Example 2

A sealed container of the type shown in FIG. 4 was constructed using he same closure material, cup-shaped container and intermediate material as in Example 1.

A tight seal between the container and the intermediate material was first formed by heat sealing. After water was filled in the container to an extent of about 90% of the total volume, an easily peelable seal with the intermediate material was formed to seal up the container. The sealing conditions for forming the easily peelable seal and the tight seal are shown in Table 1.

The positions of the inside and outside end edges of the easily peelable seal portion and the positions of the inside and outside end edges of the tight seal portion were regulated by forming a nonadhesive aluminum film on both surfaces of the intermediate material by vacuum deposition so that their respective positions were regulated. As in Example 1, the seal widths of the easily peelable seal portion and the tight seal portion were adjusted respectively to 3 mm and 2 mm. The distance between the inside end edges of the seal portions was adjusted to 1.5 mm, and the distance between their outside end edges, to 0.5 mm.

The peel strengths of the resulting sealed and filled container were measured by the same method as in Example 1. The results of measurement are shown in Table 1.

Example 3

The specifications of the closure material, cup-shaped container and intermediate material used in Example 3 are shown below.

Closure Material

The same closure material as used in Example 1.

Cup-Shaped Container

A 40 μm-thick non-stretched isotactic polypropylene film was laminated to one surface of a 75 μm-thick surface-treated steel foil by means of a urethane-type adhesive. A two-layered co-extruded film prepared from an isotactic polypropylene layer having a thickness of 50 μm and a 5 μm-thick layer of a blend composed of an ethylene/propylene random copolymer and 30% by weight of linear low-density polyethylene using a T-die was laminated to the other surface of the steel foil by using a urethane-type adhesive. The laminated structure was deep-drawn so that the blend layer of the co-extruded film became a seal surface, and a round container having a heat-sealing flange with a width of 6 mm was obtained.

Intermediate Material

A 50 μm-thick non-stretched isotactic polypropylene film.

A sealed and filled container of the type shown in FIG. 1 was constructed as in Example 1 using the above closure material cup-shaped container and intermediate material. The peel strengths of the container were measured by the same method as in Example 1. The heat sealing conditions and the results of measurement of the peel strengths are shown in Table 1.

Example 4

The specifications of the closure material, cup-shaped container and intermediate material used in Example 4 are shown below.

Closure Material

A 9 μm-thick soft aluminum foil was laminated to a 12 μm-thick biaxially stretched polyethylene terephthalate film by using a urethane-type adhesive to form a substrate. A two-layered co-extruded film prepared from a 50 μm-thick isotactic polypropylene layer and a 5 μm-thick layer of a blend composed of an ethylene/propylene random copolymer and 30% by weight of linear low-density polyethylene by using a T-die was laminated to the aluminum side of the substrate by using a urethane-type adhesive to form a closure material.

Cup-Shaped Container

The same cup-shaped container as used in Example 1.

Intermediate Material

A 50 μm-thick non-stretched isotactic polypropylene film.

A sealed and filled container of the type shown in FIG. 4 was constructed as in Example 2 using the above closure material cup-shaped container and intermediate material. The peel strengths of the container was measured by the same method as in Example 1. The heat sealing conditions and the results of measurement of the peel strengths are shown in Table 1.

Example 5

The specifications of the closure material, cup-shaped container and intermediate material used in Example 5 are shown below.

Closure Material

A surface-treatment for increasing film adhesion was performed on one surface of a 50 μm-thick aluminum foil, and an epoxy/phenol paint containing 10 PHR of maleic anhydride-modified polypropylene was coated and baked to a thickness of 5 μm on the treated surface as a seal layer to obtain a closure material.

Cup-Shaped Container

An epoxy/phenol paint was coated and baked to a thickness of 2 μm on one surface of a 0.2 mm-thick tin plate, and an epoxy/phenol paint containing 7 PHR of maleic anhydride-modified polypropylene was coated and baked on the other surface of the tin plate to a thickness of 5 μm. The coated plate was deep-drawn so that the side of the coating containing the modified polypropylene became a seal surface and a round container having a heat sealing flange with a width of 6 mm was obtained.

Intermediate Material

A 50 μm-thick non-stretched isotactic polypropylene film.

A sealed and filled container of the type shown in FIG. 1 was constructed as in Example 1 using the above closure material cup-shaped container and intermediate material. The peel strengths of the container were measured by the same method as in Example 1. The heat sealing conditions and the results of measurement of the peel strengths are shown in Table 1.

Example 6

The specifications of the closure material, cup-shaped container and intermediate material used in Example 6 are shown below.

Closure Material

A surface-treatment for increasing film adhesion was performed on one surface of a 50 μm-thick aluminum foil, and an epoxy/phenol paint was coated and baked to a thickness of 5 μm on the treated surface as a seal layer to obtain a closure material.

Cup-Shaped Container

A 20 μm-thick film of a three-component blend composed of polyethylene terephthalate isophthalate, polybutylene terephthalate isophthalate and an ionomer was heat-bonded to one surface of a 0.5 mm-thick polyethylene terephthalate sheet containing a nucleating agent. The resulting sheet was pressure-formed so that the blend film side became a seal surface. After pressure-formation, the article was heat-treated to produce a square container having a heat-sealing flange with a width of 6 mm.

Intermediate Material

An 80 μm film of a four-component blend composed of polyethylene terephthalate, polyethylene terephthalate isophthalate, polybutylene terephthalate isophthalate and an ionomer.

A sealed and filled container of the type shown in FIG. 4 was constructed as in Example 2 using the above closure material cup-shaped container and intermediate material. The peel strengths of the container were measured by the same method as in Example 1. The heat sealing conditions and the results of measurement of the peel strengths are shown in Table 1.

Example 7

A pouch shown in FIG. 10 was constructed by using a wrapping material obtained by laminating a 9 μm soft aluminum foil to a 12 μm-thick biaxially stretched polyethylene terephthalate film by means of a urethanetype adhesive to form a substrate, and laminating a 70 μm non-stretched isotactic polypropylene film to the aluminum side of the substrate as a seal layer, and the same intermediate material as used in Example 1.

Heat sealing was effected by using an impulse sealer. First, a tight seal was formed, and then an easily peelable seal. The seal widths of the easily peelable seal portion and the tight seal portion were adjusted to 5 mm. The easily peelable seal was shifted by 2.5 mm inwardly of the pouch with respect to the tight seal, and the positional relation shown in FIG. 11, (a) was maintained.

A rectangular sample with a width of 15 mm was cut out from the opening start portion of the so produced pouch at right angles to the sealing direction, and its T peel strength was measured at a pulling speed of 300 mm/min. The results of measurement of the T peel strength from inside and outside of the pouch are shown in Table 2.

Comparative Examples 1 and 2

Figure 11A:
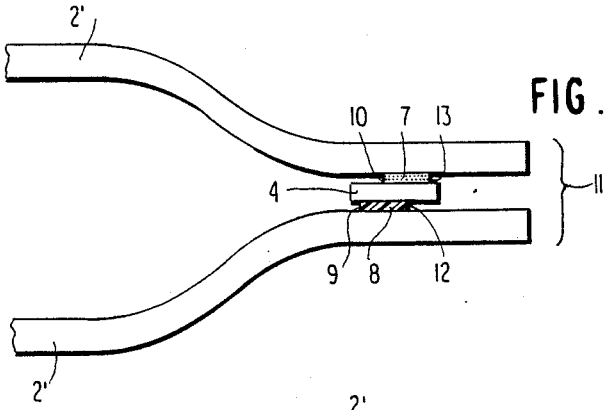
FIG. 11 gives sectional views for illustrating the positional relation between an easily peelable seal portion and a tight seal portion in the sealed containers of Example 7 and Comparative Examples 1 and 2.
Figure 11B:
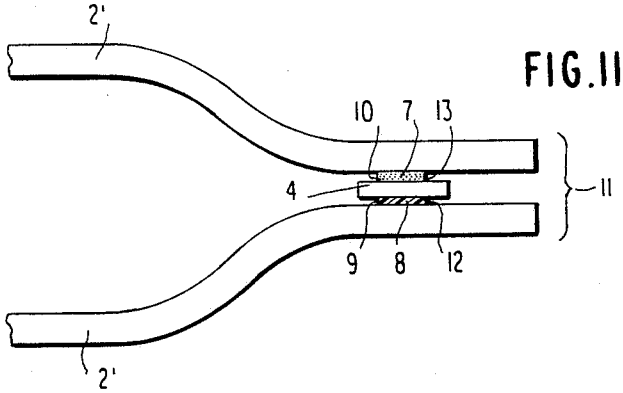
Figure 11C:
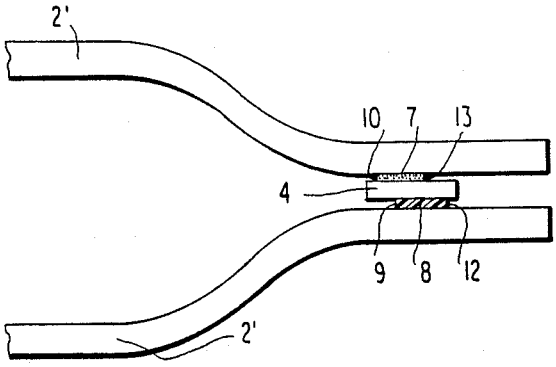

In Example 7, the easily peelable seal was shifted by 2.5 mm inwardly of the pouch with respect to the tight seal and the positional relation shown in FIG. 11, (a) was maintained. A pouch was produced in the same way as in Example 7 except that the tight seal and the easily peelable seal were maintained in the same positional relation as shown in FIG. 11, (b) [Comparative Example 1], or the easily peelable seal was shifted by 2.5 mm outwardly of the pouch with respect to the tight seal and the positional relation shown in FIG. 11, (c) was maintained [Comparative Example 2].

The T-peel strengths of the pouches were measured by the same method as in Example 7. The results of the measurement are shown in Table 2.

The object of this invention is to provide a sealed container which can withstand falling impact and the increasing of the internal pressure by retorting and can be easily opened from outside. As can be seen from Tables 1 and 2, in Examples 1 to 7, the peel strengths from the inside of the containers were more than 2.3 kg/15 mm width and could withstand the increasing of the internal pressure during retorting. The peel strengths from the outside of the containers were less than 2 kg/15 mm width showing an easily peelable seal. When the opening start portions of the containers of Examples 1 to 7 were held by hand and peeled, they could be easily opened. However, in Comparative Examples 1 and 2, the effects intended by this invention were not observed, and the container of Comparative Example 2 could not be opened by hand.

TABLE 1

| | Heat seal conditions | | | | Peel strength (kg/15 mm width) | | | |
|---|---|---|---|---|---|---|---|---|
| | Easily peelable seal | | Tight seal | | Before retorting | | After retortion | |
| Example | seal head temp. (°C.) | sealing time (sec.) | seal head temp. (°C.) | sealing time (sec.) | from inside | from outside of the opening start part | from inside | from outside of the opening start part |
| 1 | 170 | 1 | 190 | 1 | 3.0 | 1.5 | 2.9 | 1.4 |
| 2 | 190 | 1 | 180 | 1 | 3.1 | 1.7 | 3.2 | 1.8 |
| 3 | 170 | 1 | 190 | 1 | 2.8 | 1.6 | 2.9 | 1.5 |
| 4 | 190 | 1 | 180 | 1 | 2.9 | 1.4 | 3.0 | 1.3 |
| 5 | 180 | 1 | 200 | 1 | 3.5 | 1.3 | 3.4 | 1.5 |
| 6 | 220 | 0.8 | 200 | 1.2 | 4.2 | 1.8 | 4.7 | 1.7 |

TABLE 2

| | Amount of positional shifting of the easily peelable seal with respect to the tight seal | T-peel strength from inside (kg/15 mm width | T-peel strength from outside of the opening start part (kg/15 mm width) |
|---|---|---|---|
| Example 7 | 2.5 mm inwardly | 4.8 | 1.0 |
| Comparative Example 1 | the same position | 0.8 | 0.9 |
| Comparative Example 2 | 2.5 mm outwardly | 1.0 | 5.1 |

Example 8

The closure material, cup-shaped container and intermediate material used in Example 8 are shown below.

Closure Material

A 9 μm-thick soft aluminum foil was laminated to a 12 μm-thick biaxially stretched polyethylene terephthalate film by using a urethane-type adhesive to form a substrate. A 50 μm-thick non-stretched polypropylene film was laminated to the aluminum side of the substrate as a heat seal layer by using a urethane-type adhesive to obtain a closure material.

Cup-Shaped Container

A 40 μm-thick non-stretched polypropylene film was laminated to one surface of a 75 μm-thick surface-treated steel foil by a urethane-type adhesive, and a 70 μm-thick non-stretched polypropylene film was laminated to the other surface of the surface-treated steel foil by using a urethane-type adhesive. The laminated structure was deep-drawn so that the 70 μm-thick film side became a heat seal surface, and a round container having an outside diameter of 78 mm with a heat sealing flange having a width of 5 mm was obtained.

Intermediate Material

A two-layered co-extruded film composed of a 45 μm-thick polypropylene layer (layer A) and a 5 μm-thick blend layer (layer B) composed of an ethylene/-propylene random copolymer and 30% by weight of linear low-density polyethylene.

A sealed container of the type shown in FIG. 5 was constructed by using the above closure material, cup-shaped container and intermediate material. The intermediate material was provided over the entire circumference of the heat seal surface, and caused to jut out by 3 mm outwardly of the flange. The container and the intermediate layer (layer B) were heat-sealed (to form an easily peelable seal). After water was filled in the container to an extent of about 90% of the total volume, the intermediate material (layer A) and the closure were heat-sealed (to form a tight seal) thereby to seal up the container.

The easily peelable seal was formed over the entire heat seal surface via a 12 μm-thick biaxially stretched polyethylene terephthalate film between the intermediate material and a heat seal head. The tight seal was formed by regulating the shape and position of the heat seal head so that the distance between the inside end edge of the easily peelable seal portion and the inside end edge of the tight seal portion became 2 mm and the outside end edge of the tight seal portion was located outwardly of the flange. The heat sealing conditions for forming the easily peelable seal and the tight seal are shown in Table 3.

The peel strength and opening strength of the resulting sealed end filled container were measured by using a tensile tester after the container were retorted at 120° C. for 50 minutes. Specifically, a rectangular sample with a width of 15 mm was cut out from the container at right angles to the sealing direction. The closure side of the rectangular sample was clamped by an upper chuck, and the side wall of the cup by a lower chuck. The sample was pulled vertically at a speed of 300 mm/min. The opening strength of the container was measured by fixing the container to a cross head at an inclination of 45°. The holding portion for opening the closure was held by the upper chuck (the angle formed by the upper surface of the container and the holding portion of the closure was 45°). The container was then pulled vertically at a speed of 300 mm/min. The peel or break strength from the inside of the container and the peel strength and opening strength of the opening start part of the container from outside were measured, and the results are shown in Table 3.

Example 9

The specifications of the closure material, cup-shaped container and intermediate material used in Example 9 are shown below.

Closure Material

The same closure material as used in Example 8.

Cup-Shaped Container

A 40 μm-thick non-stretched polypropylene film was laminated to one surface of a 75 μm-thick surface-treated steel foil by using a urethane-type adhesive, and a two-layered co-extruded film composed of a 45 μm-thick polypropylene layer and a 5 μm-thick blend layer composed of an ethylene/propylene random copolymer and 30% by weight of linear low-density polyethylene was laminated to the other surface of the surface-treated steel foil by using a urethane-type adhesive. The laminated structure was deep-drawn so that the co-extruded film side became a heat seal surface, and a round container having an outside diameter of 78 mm with a heat sealing flange having a width of 5 mm was obtained.

Intermediate Material

A 50 μm-thick non-stretched polypropylene film.

A sealed and filled container of the type shown in FIG. 5 was constructed as in Example 8 using the above closure material, cup-shaped container and intermediate material. The peel strength (or break strength) and opening strength of the sealed container were measured by the same method as in Example 8. The heat sealing conditions and the results of measurements are shown in Table 3.

Example 10

The specifications of the closure material, cup-shaped container and intermediate material used in Example 10 are shown below.

Closure Material

A surface-treatment for increasing film adhesion was performed on one surface of a 50 μm-thick aluminum foil, and an epoxy/phenol paint containing 10 PHR of maleic anhydride-modified polypropylene was coated and baked on the treated surface of the aluminum foil to a thickness of 5 μm as a seal layer.

Cup-Shaped Container

An epoxy/phenol paint was coated and baked to a thickness of 2 μm on one surface of a 0.2 mm-thick tin plate, and on its other surface, an epoxy/phenol paint containing 3 PHR maleic anhydride-modified polypropylene was coated and baked to a thickness of 5 μm. The coated tin plate was deep-drawn so that the side of the coated film containing the modified polypropylene became a heat seal surface, and a round container having an outside diameter of 78 mm with a heat sealing flange having a width of 5 mm was obtained.

Intermediate Material

A 50 μm-thick non-stretched polypropylene film.

A sealed and filled container of the type shown in FIG. 5 was constructed as in Example 8 using the above closure material, cup-shaped container and intermediate material. The peel strength (or break strength) and opening strength of the sealed container were measured by the same method as in Example 8. The heat sealing conditions and the results of measurements are shown in Table 3.

Example 11

The specifications of the closure material, cup-shaped container and intermediate material used in Example 11 are shown below.

Closure Material

A 12 μm-thick biaxially stretched polyethylene terephthalate film, a 15 μm-thick biaxially stretched nylon-6 film and a 20 μm-thick soft aluminum foil were laminated using a urethane-type adhesive to form a substrate. A 15 μm-thick maleic anhydride-modified polypropylene layer and a 35 μm-thick layer of a blend of an ethylene/propylene random copolymer and 20% by weight of linear low-density polyethylene were coated on the aluminum side of the substrate by co-extrusion to form a closure material.

Cup-Shaped Container

A 2 mm-thick polypropylene sheet was vacuum-formed to give a square container having one side measuring 80 mm and including a heat sealing flange with a width of 3 mm.

Intermediate Material

The same intermediate material as used in Example 8.

Figure 13:
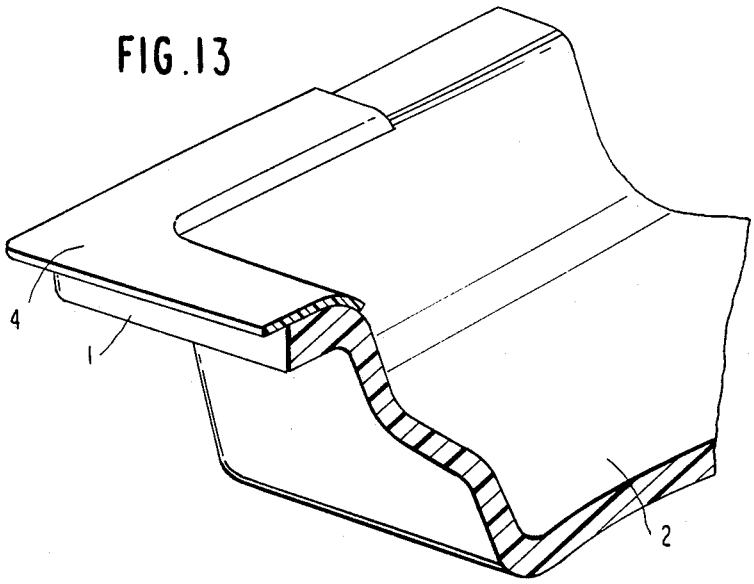
FIG. 13 is a perspective view illustrating the state in which an intermediate material is applied only to an opening start part.

A sealed and filled container of the type shown in FIG. 9 was constructed as in Example 8 using the above closure material, cup-shaped container and intermediate material. The intermediate material was provided only at one corner (opening start portion) of the container as shown in FIG. 13. The peel strength (or break strength) and opening strength were measured by the same method as in Example 8. The heat sealing conditions and the results of measurements are shown in Table 3.

Example 12

The specifications of the closure material, cup-shaped container and intermediate material used in Example 12 are shown below.

Closure Material

A 9 μm-thick soft aluminum foil was laminated to a 12 μm-thick biaxially stretched polyethylene terephthalate by a urethane adhesive to form a substrate. A 50 μm-thick film of a four-component blend composed of polyethylene terephthalate, polyethylene terephthalate isophthalate, polybutylene terephthalate isophthalate and an ionomer was laminated as a heat seal layer to the aluminum side of the substrate by using a urethane-type adhesive to give a closure material.

Cup-Shaped Container

A co-extruded sheet composed of a 0.2 mm-thick polyethylene terephthalate layer (layer A) and a 0.8 mm-thick polyethylene terephthalate layer (layer B) containing a nucleating agent was vacuum-formed so that the layer A became a heat seal surface. The formed article was heat-treated to give a round container having an outside diameter of 78 mm with a heat sealing flange having a width of 6 mm.

Intermediate Material

A two-layered co-extruded film composed of a 60 μm-thick (layer C) of a blend composed of polyethylene terephthalate, polyethylene terephthalate isophthalate, polybutylene terephthalate isophthalate and an ionomer and a 10 μm-thick layer (layer D) of a blend composed of polyethylene terephthalate isophthalate, polybutylene terephthalate isophthalate and an ionomer.

A sealed and filled container of the type shown in FIG. 5 was constructed by using the above closure material, cup-shaped container and intermediate material. The layer D side of the intermediate material was heat sealed to the cup-shaped container, and its layer C side, to the closure material. The peel strength (or break strength) and opening strength were measured by the same method as in Example 8. The heat sealing conditions and the results of measurements are shown in Table 3.

Example 13

The specifications of the closure material, cup-shaped container and intermediate material in Example 13 are shown below.

Closure Material

The same closure material as used in Example 12.

parative Example 3, the container had a peel strength of more than 2.3 kg/15 mm width, but an opening strenth of more than 4.0 kg. It was difficult to open by hand.

TABLE 3

| Example (Ex.) or Comparative Example (CEx.) | Easily peelable seal: seal head temp. (°C.) | Easily peelable seal: sealing time (sec.) | Tight seal: seal head temp. (°C.) | Tight seal: sealing time (sec.) | Peel strength (break strength) (kg/15 mm width): peel or break strength from inside | Peel strength (break strength) (kg/15 mm width): peel strength from outside of the opening start part | Opening strength (kg) from the outside of the opening start part |
|---|---|---|---|---|---|---|---|
| Ex.8 | 170 | 1 | 210 | 1 | 3.0 | 1.0 | 1.8 |
| Ex. 9 | 170 | 1 | 210 | 1 | 3.1 | 0.9 | 1.7 |
| Ex. 10 | 190 | 1 | 200 | 1 | 2.8 | 0.9 | 1.5 |
| Ex. 11 | 170 | 1 | 210 | 1 | 2.9* | 1.2 | 1.9 |
| Ex. 12 | 220 | 0.8 | 220 | 1.2 | 3.5 | 0.8 | 1.6 |
| Ex. 13 | 220 | 0.8 | 220 | 1.2 | 3.2 | 0.8 | 1.7 |
| CEx. 3 | — | — | 210 | 1 | 2.5 | 2.5 | 4.3 |

*The peel strength (break strength) from inside in Example 11 shows that of a portion where the intermediate material was inserted.

Cup-Shaped Container

A surface-treatment for increasing film adhesion was performed on both surfaces of a 0.13 mm-thick aluminum foil. An epoxy/phenol paint was coil-coated to a thickness of 5 μm on one surface of the treated aluminum foil, and an epoxy/urea paint was coil-coated on its other surface to a thickness of 3 μm. A square container having one side measuring 80 mm with a heat sealing flange having a width of 6 mm was produced by deep-drawing the coated foil so that its epoxy/phenol film side became a heat seal surface.

Intermediate Material

The same intermediate material as used in Example 12.

A sealed and filled container of the type shown in FIG. 5 was constructed as in Example 8 by using the above closure material, cup-shaped container and intermediate material. The layer D side of the intermediate material was heat sealed to the cup-shaped container, and its layer C side, to the closure material. The peel strength (or break strength) and opening strength were measured by the same method as in Example 8. The heat sealing conditions and the results of measurements are shown in Table 3.

Comparative Example 3

A sealed and filled container was constructed by using the same closure material and cup-like container used in Example 11 without inserting any intermediate material into the heat seal portion. The peal strength and opening strength were measured by the same method as in Example 8. The heat sealing conditions and the results of measurements are shown in Table 3.

The object of this invention is to provide a sealed cotainer which can withstand falling impact and the increasing of the internal pressure by retorting and can be easily opened with accuracy and stability. As can be seen from Table 3, in Examples 8 to 13, the peel or break strengths from the inside of the containers were more than 2.3 kg/15 mm width and could withstand the increasing of the internal pressure during retorting, and the peel strengths from the outside of the containers were about 1 kg/15 mm width showing an easily peelable seal. When the opening start positions of the containers of Examples 8 to 13 were held by hand and peeled, they could be easily opened. However, in Com-

We claim:

1. A container composed of a plurality of container materials the opposing parts of which are sealed by heat sealing, wherein
   - at least an opening start part of the sealed portion is of a laminated structure consisting of the plurality of container materials and an intermediate material inserted therebetween,
   - the intermediate material and one of the container materials are tightly sealed,
   - the intermediate material and another of the container materials are sealed easily peelably,
   - the inside end edge of the easily peelable seal portion is positioned more toward the center of the container than the inside end edge of the tight seal portion, and
   - at an opening start position, the outside end edge of the easily peelable seal portion is positioned more toward the center of the container than the outside end edge of the tight seal portion.

2. The sealed container of claim 1 in which one of the container materials is a cup-shaped container provided with a heat sealing flange, and the other is a closure.

3. The sealed container of claim 1 in which the plurality of container materials are two pieces of a pouch-constituting material.

4. An easily openable sealed container composed of a cup-shaped container body having a heat sealing flange and a closure which are sealed by heat sealing, wherein
   - at least an opening start part of the sealed portion has an intermediate material inserted so as to jut outwardly of a heat sealing flat portion of the flange,
   - the intermediate material and the flange are sealed easily peelably,
   - the intermediate material and the closure are tightly sealed.
   - the inside end edge of the easily peelable seal portion is positioned more inwardly of the container than the inside end edge of the tight seal portion, and
   - at an opening start position, the outside end edge of the tight seal portion is positioned more outwardly than the heat sealing flat portion of the flange.

5. The sealed container of claim 4 in which the intermediate material is provided such that at least at the opening start part of the sealed portion it juts outwardly of the peripheral end portion of the flange.

6. The sealed container of claim 4 in which the flange of the cup-shaped container has a heat sealing flat portion and a peripherally extending portion provided outwardly and downwardly of the flat portion via a step, and no heat sealing is effected between the intermediate material and the peripherally extending portion.

7. The sealed container of claim 4 in which the intermediate material is provided so as to jut also inwardly of the heat sealing flat portion of the flange, and this jutting portion of the intermediate material is heat sealed to the container body.

* * * * *